United States Patent [19]

Mihara et al.

[11] Patent Number: 4,493,889

[45] Date of Patent: Jan. 15, 1985

[54] SILVER HALIDE PHOTOGRAPHIC LIGHT-SENSITIVE MATERIALS

[75] Inventors: Yuji Mihara; Satoshi Nagaoka; Masaki Okazaki, all of Kanagawa, Japan

[73] Assignee: Fuji Photo Film Co., Ltd., Kanagawa, Japan

[21] Appl. No.: 573,181

[22] Filed: Jan. 23, 1984

[30] Foreign Application Priority Data

Jan. 24, 1983 [JP] Japan ..... 58-9613

[51] Int. Cl.[3] ..... G03C 1/02

[52] U.S. Cl. ..... 430/572; 430/503; 430/505; 430/550; 430/573; 430/576; 430/592

[58] Field of Search ..... 430/572, 573, 576, 592, 430/503, 505, 550

[56] References Cited

U.S. PATENT DOCUMENTS

| | | | |
|---|---|---|---|
| 2,875,058 | 2/1959 | Carroll et al. | 430/572 |
| 3,416,927 | 12/1968 | Kalenda | 430/572 |
| 3,615,632 | 10/1971 | Shiba et al. | 430/572 |
| 4,002,480 | 1/1977 | Hinata et al. | 430/572 |

*Primary Examiner*—J. Travis Brown

*Attorney, Agent, or Firm*—Sughrue, Mion, Zinn, Macpeak and Seas

[57] ABSTRACT

A silver halide photographic light-sensitive material is disclosed. The material is comprised of a support having thereon a red-sensitive silver halide photographic emulsion layer comprising a tetramethine melocyanine dye represented by the general formula (I) and a compound represented by the general formula (II)

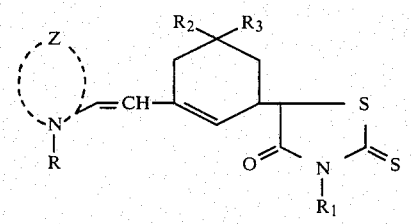

(I)

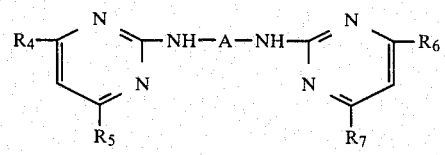

(II)

the substituents within these structural formulae are defined within the specification. The material gives improved results with respect to preventing diffuse sensitization. The material also provides a red-sensitive silver halide photographic emulsion in which a decline of spectro-sensitivity in the lapse of dissolution is relatively small and which has a small amount of dye fog.

17 Claims, No Drawings

SILVER HALIDE PHOTOGRAPHIC LIGHT-SENSITIVE MATERIALS

FIELD OF THE INVENTION

This invention relates to a silver halide photographic light-sensitive material (which is hereafter referred to as "a photographic material") having a red-sensitive silver halide photographic emulsion layer (which is hereafter referred to as "a red-sensitive emulsion layer") which has improved spectral sensitization, and more particularly, it relates to a photographic material (which may or may not contain couplers) which is composed of at least two layers, a red-sensitive emulsion layer and at least one more silver halide photographic light-sensitive emulsion layer (which is hereafter referred to as "an emulsion layer").

BACKGROUND OF THE INVENTION

It is well known that for the production of a photographic material, particularly a color photographic material, a multi-layer structure consisting of at least a red-sensitive emulsion layer, at least one more emulsion layer, intermediate layers and the other layers is generally employed. In this case, it is also well known that a spectral sensitization process (i.e., a technique in which some kind of sensitizing dye is added to a silver halide photographic emulsion (which is hereafter referred to as "an emulsion") to extend the light-sensitive wavelength range towards the longer wavelength side) is used in order to give color sensitivities of blue sensitivity, green sensitivity, red sensitivity and the like to each emulsion layer.

The strength of spectral sensitization is influenced by the chemical structure of sensitizing dyes, properties of emulsions (e.g., halogen composition of a silver halide, crystal habit, crystal system, silver ion concentration, hydrogen ion concentration, etc.) and the like. Moreover, the spectral sensitivity is also influenced by photographic additives such as stabilizer, antifoggant, coating assistant, colored coupler and the like which coexist in the emulsion. Among the sensitizing dyes, as a sensitizing dye which affords red sensitivity, for example, the carbocyanine dye containing a quinoline nucleus as described in U.S. Pat. No. 3,556,800, the rhodacyanine dye as described in Japanese Patent Publication No. 4930/68, the melocyanine dye as described in U.S. Pat. No. 3,416,927, the dicarbocyanine dye as described in U.S. Pat. Nos. 2,503,776 and 3,635,721 and Japanese Patent Publication No. 550/71, or "The Cyanine Dyes and Related Compounds" by Hamer (1964), p. 207, and the like have been known.

However, it is also well known that when these sensitizing dyes are added to the emulsion, a supplementary effect which is photographically detrimental is caused. Detrimental supplementary effects include the occurrence of fog which results from the addition of a sensitizing dye (which is hereinafter referred to as "dye fog") and diffuse sensitization [this means that the sensitizing dye does not stay only in the emulsion layer in which the dye is first added, diffusing to another emulsion layer layer over time, and thus an unpreferable sensitization is caused by the diffusing dye in the diffused layer (which is hereinafter referred to as "diffuse sensitization")]. They are important obstacles in the production of multilayer color photographic materials having high spectral sensitivity.

In dye fog, when the used photographic material is a photographic paper, even a small increase in fog is not desirable and remarkably decreases the commercial value. In order to improve the dye fog, when a fog inhibitor or stabilizer which are generally used is used together with the sensitizing dye, the fog can be inhibited. However, this causes a lowering of the spectral sensitivity in some cases or an increased decline of the spectral sensitivity over time. Accordingly, this kind of fog inhibitor is required a strict selectivity against the spectral sensitizing dye used.

In diffuse sensitization, the sensitizing dye added to a red-sensitive emulsion layer diffuses in a green-sensitive silver halide photographic emulsion layer (which is hereafter referred to as "a green-sensitive emulsion layer") and/or a blue-sensitive silver halide photographic emulsion layer (which is hereafter referred to as "a blue-sensitive emulsion layer"), and the diffusing dye causes a panchromatic sensitization, resulting in color mixing (turbidity) of the color image, a lowering of the green sensitivity of the green-sensitive emulsion layer and a lowering of the blue sensitivity of the blue-sensitive emulsion layer. Accordingly, the diffuse sensitization causes serious problems with respect to photographic efficiency.

Accordingly, to develop a spectral sensitizing dye which hardly affords diffuse sensitization has been an important object of persons skilled in the art.

On the other hand, the desorption or decomposition of the sensitizing dye or a change of the absorpting condition in the emulsion solution before coating causes a change in spectral sensitivity or an increase in fog over time before coating (hereinafter called to as "lapse of dissolution property"). This fact is an important obstacle for the stable production of a photographic material having high sensitivity.

Melocyanine dyes, particularly tetramethine melocyanine dyes, are generally superior with respect to their color sensitizing property (sensitivity), spectral sensitivity distribution, printer suitability, temperature and humidity dependence at exposure, solubility of dye and the like, compared with the carbocyanine dye containing a quinoline nucleus, the rhodacyanine dye and the dicarbocyanine dye which are similarly used for red color sensitization.

Furthermore, the tetramethylene melocyanine dye is desirable because it hardly causes dye stains after development. On the other hand, however, it has disadvantages in that the diffuse sensitizing property is large, the sensitivity in the lapse of dissolution is widely lowered and the dye fog is large.

Accordingly, it is difficult in fact to use tetramethine melocyanine dye by itself due to these difficulties. However, if these difficulties can be removed by any device, the tetramethine melocyanine dye can become a quite useful red sensitizing dye.

Examples using melocyanine dyes are described in U.S. Pat. Nos. 3,416,927, 4,002,480 and the like. Using a tetramethine melocyanine dye together with a s-triazine compound is described in U.S. Pat. No. 3,416,927. However, although the sensitivity is higher than when using the dye alone, the dye fog and the diffuse sensitization are not sufficiently improved. Using a melocyanine dye together with a compound containing a pyrimidine nucleus is described in U.S. Pat. No. 4,002,480. However, although the dye fog and the like are improved, the lapse of dissolution property is not improved sufficiently and thus the diffuse sensitizing property must be further improved.

SUMMARY OF THE INVENTION

A primary object of this invention is to provide a red-sensitive silver halide photographic emulsion (which is hereafter referred to as "a red-sensitive emulsion") in which diffuse sensitization is prevented.

Another object is to provide a red-sensitive emulsion in which a decline of spectral sensitivity in the lapse of dissolution (in an emulsion before coating) is small.

Yet another object is to provide a red-sensitive emulsion having a small amount of dye fog.

Still another object is to provide a red-sensitive emulsion having high spectral sensitivity.

As a result of various studies on combinations of tetramethine melocyanine dye and various additives, the present inventors have found that the above-mentioned purposes of this invention can be achieved effectively by using:

A silver halide photographic light-sensitive material, comprising:

a support having thereon a red-sensitive silver halide photographic emulsion layer comprising a tetramethine melocyanine dye represented by the general formula (I) and a compound represented by the general formula (II)

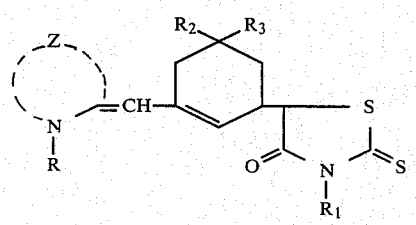

(I)

R and $R_1$ each represents an alkyl group, a substituted alkyl group, an aryl group, a substituted aryl group or an alkyl group, and at least one of R and $R_1$ represents an alkyl group containing a sulfo group or an alkyl group containing a carboxyl group, $R_2$ and $R_3$ each represents an alkyl group, and Z represents a nonmetal atomic group necessary to complete a 5-membered or 6-membered heterocyclic nucleus containing nitrogen,

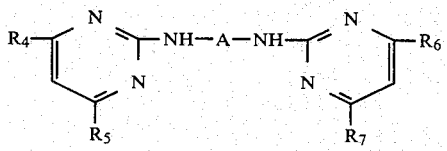

(II)

wherein A represents a divalent aromatic residue, and $R_4$, $R_5$, $R_6$ and $R_7$ independently represent a hydrogen atom, a hydroxy group, a lower alkyl group, an alkoxy group, an aryloxy group, a halogen atom, a heterocyclic group, an alkylthio group, a heterocyclylthio group, an arylthio group, an amino group, a substituted or unsubstituted alkylamino group, a substituted or unsubstituted arylamino group, a heterocyclylamino group, a substituted or unsubstituted aralkylamino group, an aryl group or a mercapto group, and at least one of A, $R_4$, $R_5$, $R_6$ and $R_7$ represents a group substituted with at least one sulfo group.

DETAILED DESCRIPTION OF THE INVENTION

In order to more specifically describe the invention, the substituents of the above disclosed general formulae(I) and (II) will now be more specifically described.

In the general formula (I), R and $R_1$ each represents an alkyl group (those containing 1 to 10 carbon atoms are suitable and those containing 1 to 5 carbon atoms are preferred) (e.g., methyl, ethyl, 3-propyl, 4-butyl, 3-butyl, 5-pentyl groups, etc.), a substituted alkyl group (wherein the alkyl moiety containing 1 to 10 carbon atoms, preferably 1 to 5 carbon atoms), for example, an alkyl group containing a sulfo group (preferably, an alkyl moiety containing 1 to 4 carbon atoms) [e.g., a sulfoalkyl group {e.g., 2-sulfoethyl, 3-sulfopropyl, 3-sulfobutyl, 4-sulfobutyl groups, etc.}, an alkyl group substituted by a hydroxy, acetoxy or alkoxy (the alkyl moiety preferably containing 1 to 4 carbon atoms) group and a sulfo group {e.g., 2-hydroxy-3-sulfopropyl, 2-(3-sulfopropoxy)ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3'-sulfopropoxy)-propyl groups, etc.}, a sulfoaralkyl group {e.g., p-sulfophenethyl, p-sulfobenzyl groups, etc.} and the like], an alkyl group containing a carboxyl group (preferably, the alkyl moiety containing 1 to 4 carbon atoms), [e.g., carboxymethyl, 2-carboxyethyl, 3-carboxypropyl, 2-(2-carboxyethoxy)ethyl, p-carboxybenzyl groups, etc.], an aralkyl group [e.g., benzyl, phenethyl, phenylpropyl, phenylbutyl, alkyl-substituted aralkyl (e.g., p-methylphenethyl, p-tolylpropyl, etc.), alkoxy-substituted aralkyl (e.g., p-methoxyphenethyl, etc.), halogen-substituted aralkyl (e.g., p-chloro-phenethyl, m-chlorophenethyl, etc.) groups and the like], an aryloxyalkyl group [e.g., phenoxyethyl, phenoxypropyl, phenoxybutyl, alkyl- or alkoxy-substituted aryloxyalkyl (e.g., p-methyl phenoxyethyl, p-methoxy phenoxypropyl groups, etc.) groups and the like], an aryl group [preferably containing 4 to 15 carbon atoms, e.g., phenyl, pyridyl groups, etc.], a substituted aryl group (the aryl moiety preferably containing 4 to 15 carbon atoms, and as the substituent, the substituents of the substituted alkyl group are used. For example, p-methylphenyl, p-methoxyphenyl groups, etc.), and an allyl group.

At least one of R and $R_1$ represents an alkyl group containing a sulfo group or an alkyl group containing a carboxyl group.

$R_2$ and $R_3$ each represents an alkyl group (the preferable containing 1 to 5 carbon atoms. For example, methyl, ethyl, propyl groups, etc.).

Z represents a nonmetal atomic group necessary to complete a 5-membered or 6-membered heterocyclic nucleus containing nitrogen together with a nitrogen atom. Examples of the heterocyclic nucleus include a thiazole nucleus (e.g., thiazole, 4-methylthiazole, 4-phenylbenzothiazole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluorobenzothiazole, 5,6-dimethylbenzothiazole, 5-hydroxy-6-methylbenzothiazole, tetrahydrobenzothiazole, 4-phenylbenzothiazole, naphtho(2,1-d)thiazole, naphtho(1,2-d)thiazole, naphtho(2,3-d)thiazole, 5-methoxynaphtho(1,2-d)thiazole, 7-ethoxynaphtho(2,1-d)thiazole, 8-methoxynaphtho(2,1-d)thiazole, 5-methoxynaphtho(2,3-d)thiazole, etc.), a gelenazole nucleus (e.g., 4-methylgelenazole, 4-phenylgelenazole, benzogelenazole, 5-chlorobenzogelenazole, 5-methoxybenzogelenazole, 5-methylbenzogelenazole, 5-hydroxybenzogelenazole, naphtho(2,1-d)gelenazole, naphtho(1,2-d)gelenazole, etc.), an oxazole nucleus (e.g., oxazole, 4-methyloxazole, 4-ethyloxazole, 5-methyloxazole, 4-phenyloxazole, 4,5-diphenyloxazole), benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho(2,1-d)oxazole, naphtho(1,2-d)oxazole, naphtho(2,3-d)oxazole, etc.), a quinoline nucleus (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), a 3,3-dialkylindolenine nucleus (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), an imidazole nucleus (e.g., 1-methylimidazole, 1-ethylimidazole, 1-methyl-4-phenylimidazole, 1-phenylimidazole, 1-ethyl-4-phenylimidazole, 1-methylbenzoimidazole, 1-ethylbenzoimidazole, 1-methyl-5-chlorobenzoimidazole, 1-ethyl-5-chlorobenzoimidazole, 1-methyl-5,6-dichlorobenzoimidazole, 1-ethyl-5,6-dichlorobenzoimidazole, 1-allyl-5-methoxybenzoimidazole, 1-methyl-5-cyanobenzoimidazole, 1-ethyl-5-cyanobenzoimidazole, 1-methyl-5-fluorobenzoimidazole, 1-ethyl-5-fluorobenzoimidazole, 1-phenyl-5,6-dichlorobenzoimidazole, 1-allyl-5,6-dichlorobenzoimidazole, 1-allyl-5-chlorobenzoimidazole, 1-phenylbenzoimidazole, 1-phenyl-5-chlorobenzoimidazole, 1-methyl-5-trifluoromethylbenzoimidazole, 1-ethyl-5-trifluoromethylbenzoimidazole, 1-ethyl-5-trifluoromethylbenzoimidazole, 1-ethylnaphtho(1,2-d)imidazole, etc.), a pyridine nucleus (e.g., pyridine, 5-methyl-2-pyridine, 3-methyl-4-pyridine, etc.) and the like. Among them, preferably, the thiazole nucleus and the oxazole nucleus are advantageously used. More preferably, a benzothiazole nucleus, a naphthothiazole nucleus and a naphthoxazole nucleus are advantageously used.

Preferred examples of the dye represented by the general formula (I) are indicated below.

(I - 1)

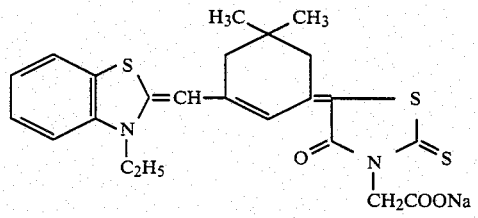

-continued (I - 2)

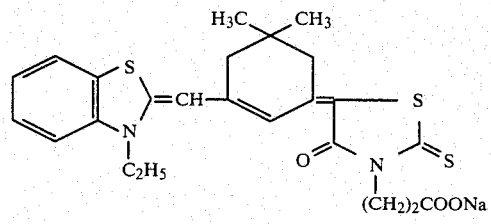

(I - 3)

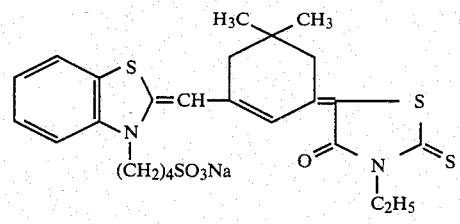

(I - 4)

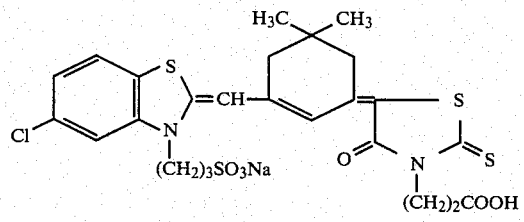

(I - 5)

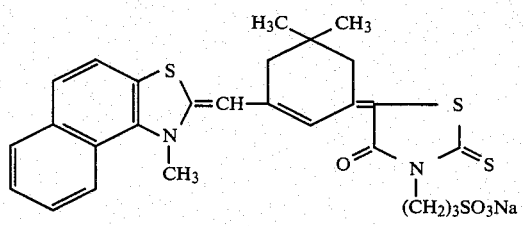

(I - 6)

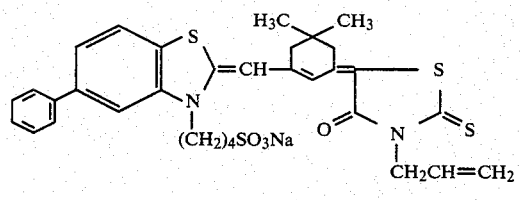

(I - 7)

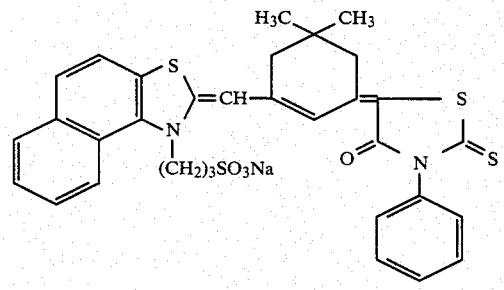

(I - 8)

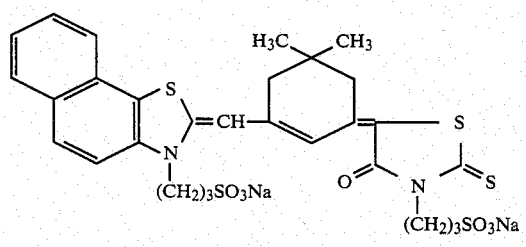

-continued

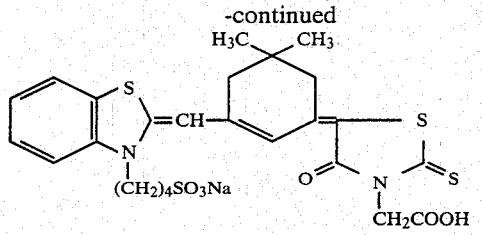

(I - 9)

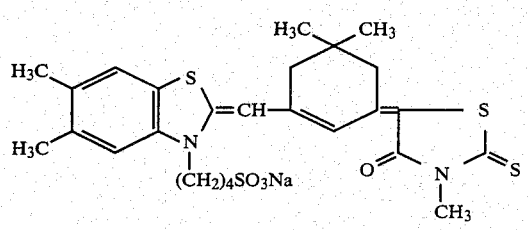

(I - 10)

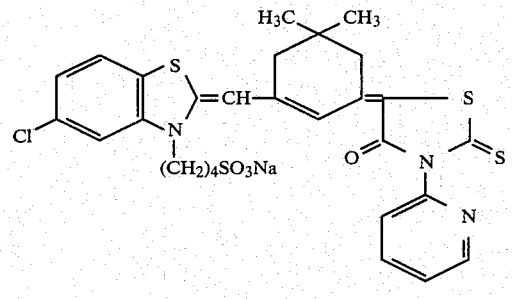

(I - 11)

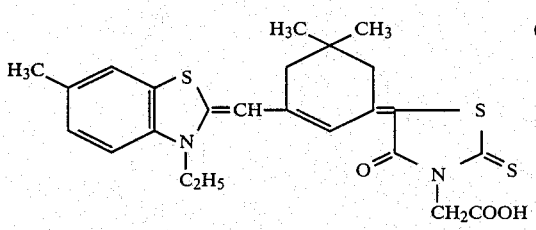

(I - 12)

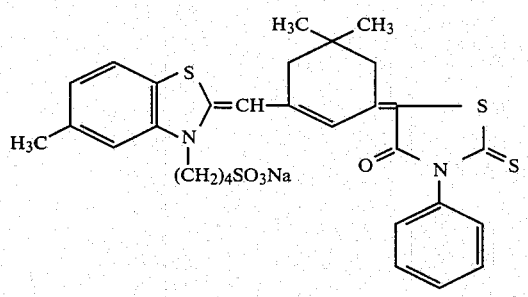

(I - 13)

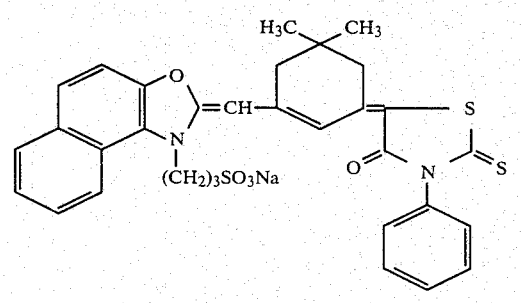

(I - 14)

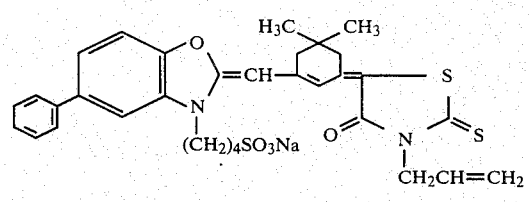

(I - 15)

-continued

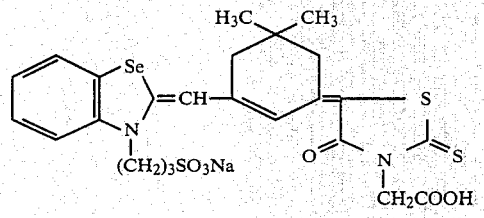

(I - 16)

The tetramethine melocyanine dye used in this invention is preferably used in a concentration of bout $2\times10^{-6}$ mol to $1\times10^{-3}$ mol per 1 mol of silver halide in the emulsion to which the dye is added, and is more preferably used in a concentration of about $5\times10^{-6}$ mol to $2\times10^{-3}$ mol per 1 mol of silver halide.

The tetramethine melocyanine dye used in this invention can be directly dispersed in the emulsion. Also, it can be added to the emulsion in a form of a solution by dissolving in a suitable solvent, for example, methyl alcohol, ethyl alcohol, methyl cellosolve, acetone, water, pyridine or a mixed solvent thereof. An ultrasonic wave can be also used for the dissolution. An adding process for the tetramethine melocyanine dye which a dye is dissolved in a volatile organic solvent and the resulting solution is dispersed in a hydrophilic colloid and this dispersion is added to the emulsion as described in U.S. Pat. No. 3,469,987. A process in which a water-insoluble dye is dispersed in a water-soluble solvent without dissolving and this dispersion is added to the emulsion is described in Japanese Patent Publication No. 42185/71. A process in which a dye is dissolved in a surface active agent and the resulting solution is added to the emulsion is described in U.S. Pat. No. 3,822,135. A process in which a dye is dissolved using a compound which cause a red shift and the resulting solution is added to the emulsion is described in Japanese Patent Application (OPI) (the term "OPI" as used herein refers to a "published unexamined Japanese patent application") No. 74624/76. A process in which a dye is dissolved in an acid which does not substantially contain water and the resulting solution is added to the emulsion is described in Japanese Patent Application (OPI) No. 80826/75. Moreover, the processes as described in U.S. Pat. Nos. 2,912,343, 3,342,605, 2,996,287, 3,429,835 and the like are also used for the addition to the emulsion. The above-mentioned tetramethine melocyanine dye may be dispersed homogeneously in the emulsion before coating on a suitable support, but, of course, it can be dispersed in any step of the preparation of the emulsion.

In the general formula (II), A represents a divalent aromatic residue and $R_4$, $R_5$, $R_6$ and $R_7$ each represents a hydrogen atom, a hydroxy group, a lower alkyl group (preferably containing 1 to 8 carbon atoms). For example, methyl, ethyl, n-propyl, n-butyl groups, etc.), an alkoxy group (preferably containing 1 to 8 carbon atoms). For example, methoxy, ethoxy, propoxy, butoxy groups, etc.), an aryloxy group (e.g., phenoxy, naphthoxy, o-toluoxy, p-sulfophenoxy groups, etc.), a halogen atom (e.g., chlorine, bromine atoms, etc.), a heterocyclic nucleus (e.g., morpholinyl, piperidyl groups, etc.), an alkylthio group (e.g., methylthio, ethylthio groups, etc.), a heterocyclylthio group (e.g., benzothiazolylthio, benzoimidazolylthio, phenyltetrazolylthio groups, etc.), an arylthio group (e.g., phenylthio, tolylthio groups), an amino group, an alkylamino or substituted alkylamino group (e.g., methylamino, ethylamino, propylamino, dimethylamino, diethylamino, dodecylamino, cyclohexylamino, β-hydroxyethylamino, di-(β-hydroxyethyl)amino, β-sulfoethylamino groups), an arylamino or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino groups, etc.), a heterocyclylamino group (e.g., 2-benzothiazolylamino, 2-pyridyl-amino groups, etc.), a substituted or unsubstituted aralkylamino group (e.g., benzylamino, o-anisylamino, m-anisylamino, p-anisylamino groups, etc.), an aryl group (e.g., phenyl group, etc.), and a mercapto group. $R_4$, $R_5$, $F_6$ and $R_7$ are independent from one another.

At least one of A, $R_4$, $R_5$, $R_6$ and $R_7$ is required to have one or more sulfo group (it may be a free acid group or make a salt), for example, a $—SO_3M$ group [M represents a hydrogen atom or a cation which affords water-solubility (e.g., sodium, potassium)].

A, which is, for example, selected from the following $A_1$ or $A_2$, is useful.

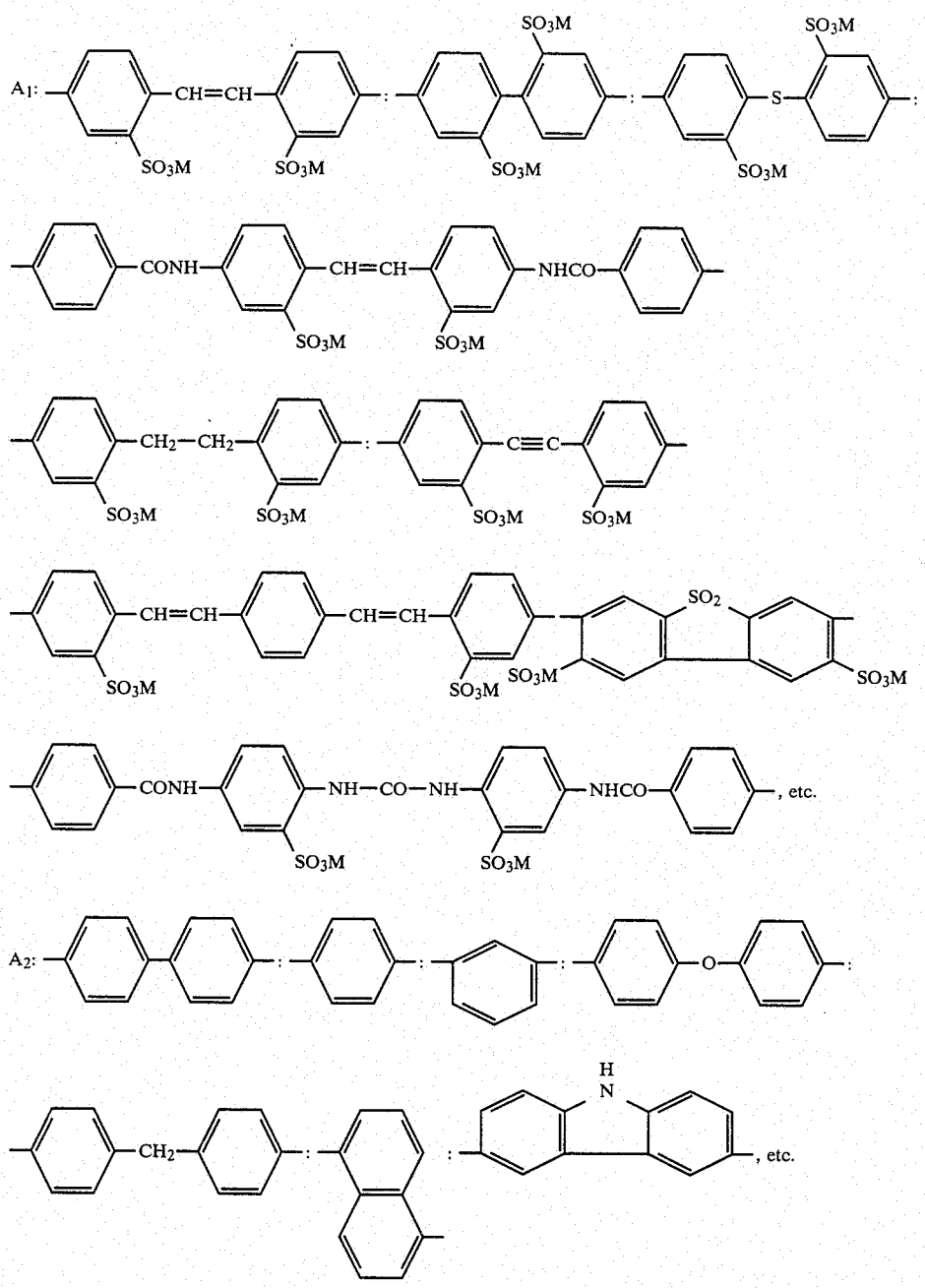

Preferred examples of the compound included in the general formula (II) which is used in this invention are as follows. However, this invention is not limited by them.

(II-1) Disodium 4,4'-bis[4,6-di(benzothiazolyl-2-thio)-pyrimidin-2-ylamino]stilbene-2,2'-disulfonate (II-2) Disodium 4,4'-bis[4,6-di(benzothiazolyl-2-amino)-pyrimidin-2-ylamino]stilbene-2,2'-disulfonate (II-3) Disodium 4,4'-bis[4,6-di(naphthyl-2-oxy)pyrimidin-2-ylamino]stilbene-2,2'-disulfonate (II-4) Disodium 4,4'-bis[4,6-di(naphthyl-2-oxy)pyrimidin-2-ylamino]bibenzyl-2,2'-disulfonate (II-5) Disodium 4,4'-bis(4,6-dianilinopyrimidin-2-ylamino)stilbene-2,2'-disulfonate (II-6) Disodium 4,4'-bis[4-chloro-6-(2-naphthyloxy)-pyrimidin-2-ylamino]biphenyl-2,2'-disulfonate (II-7) Disodium 4,4'-bis[4,6-di(1-phenyltetrazolyl-5-thio)pyrimidin-2-ylamino]stilbene-2,2'-disulfonate (II-8) Disodium 4,4'-bis[4,6-di(benzoimidazolyl-2-thio)-pyrimidin-2-ylamino]stilbene-2,2'-disulfonate (II-9) Disodium 4,4'-bis(4,6-diphenoxypyrimidin-2-ylamino)stilbene-2,2'-disulfonate (II-10) Sodium 4,4'-bis(4,6-diphenylthiopyrimidin-2-ylamino)stilbene-2,2'-disulfonate (II-11) Sodium 4,4'-bis(4,6-dimercaptopyrimidin-2-ylamino)biphenyl-2,2'-disulfonate Among these preferred examples, (II-1), (II-2), (II-3), (II-4), (II-5) and (II-7) are particularly preferable.

The compound represented by the general formula (II) which is used in this invention is preferably used in an amount of about 0.01 g to 5 g per 1 mol of the silver halide in the emulsion to which the compound is added.

The ratio (weight ratio) of the tetramethine melocyanine dye of the general formula (I) and the compound represented by the general formula (II) is advantageously in the range of the dye represented by the general formula (I)/the compound represented by the general formula (II)$=\frac{1}{2}$ to 1/200, more advantageously in the range of 1/5 to 1/100.

The compound represented by the general formula (II) which is used in this invention can be dispersed directly in the emulsion, and also can be added to the emulsion after being dissolved in a suitable solvent (for example, methyl alcohol, ethyl alcohol, methyl cellosolve, water and the like) or a mixed solvent thereof.

Besides, it can be added to the emulsion in a form of a solution or a dispersion in a colloid according to the adding processes of the sensitizing dyes.

It can be also dispersed and added to the emulsion by the process as described in Japanese Patent Application (OPI) No. 80119/75.

The emulsion of this invention can be used with a suitable supersensitizer. For example, the thiourea type compounds as described in U.S. Pat. No. 3,954,481, the reductive compounds as described in British Pat. Nos. 1,064,193 and 1,255,084 and the compounds as described in U.S. Pat. No. 2,937,089 are effectively used. The supersensitizer is preferably used in a concentration of about $1\times10^{-3}$ mol to $1\times10^{3}$ mol per 1 mol of silver halide in the emulsion to which the supersensitizer is added, although the concentration is varied depending to a kind of supersensitizer.

The silver halide used in this invention may be, for example, any of silver chloride, silver bromide, silver iodide, silver chlorobromide, silver chloroiodide, silver iodobromide, silver chloroiodobromide and the like. In this invention, among the above-mentioned silver halides, silver chloride, silver chlorobromide, silver chloroiodide and silver chloroiodobromide are preferable. The iodine content of silver chloroiodide and silver chloroiodobromide is preferred to be 1 mol% or less.

The emulsion of this invention usually employs gelatin as a vehicle, but instead of using gelatin, for example, gelatin derivatives such as an acylated gelatin, albumin, agar, gum arabic, alginic acid, hydrophilic resins such as polyvinyl alcohol and polyvinylpyrolidone, or the materials which does not afford bad effects against the light-sensitive silver halide such as cellulose derivatives may also be used.

These emulsions may be coarse grains, fine grains, or mixed grains thereof, and the silver halide grains can be formed by generally known processes, for example, single-jet process, double-jet process or controlled double-jet process.

The crystal structure of the silver halide grain may be a homogeneous structure with respect to the inside, a stratiform structure in which the inside and outside are heterogeneous and a so-called conversion type as described in British Pat. No. 635,841 and U.S. Pat. No. 3,622,318. Also, it may be either a type which forms the latent image mainly on the surface or an internal latent image type which forms inside the grain. These emulsions are described in books such as "The Theory of Photographic Process" by Mees, published by Macmillan Co., "Photographic Chemistry" by Grafikides, published by Fauntain Press and the like and *Research Disclosure,* Vol. 176 (1978, 12) RD-17643, and can be prepared by various processes such as ammonia process, neutral process, acidic process and the like which are generally known. These silver halide grains are washed with water after their formation to remove the by-produced water-soluble salts (e.g., potassium nitrate when silver bromide is prepared using silver nitrate and potassium bromide) from the system, followed by thermal treatment in the presence of a chemical sensitizer to increase the sensitivity without coarsening the grains. It can be also carried out without removing the by-produced water-soluble salts. These general processes are described in the above mentioned literatures.

When the silver halide grains are prepared, the followings are used as silver halide solvent. The examples include ammonia, potassium rhodanide, ammonium rhodanide, thioether compounds as described in U.S. Pat. Nos. 3,271,157, 3,574,628, 3,704,130, 4,297,439 and 4,276,374, thion compounds as described in Japanese Patent Application (OPI) Nos. 144319/78, 82408/78 and 77737/80, amine compounds as described in Japanese Patent Application (OPI) No. 100717/79 and the like.

The average diameter of the silver halide grain (for example, a projected area process, a measurement by number average) is preferably 0.04$\mu$ to 2$\mu$.

To the emulsion are applied the chemical sensitization processes generally used, for example, gold sensitization (U.S. Pat. Nos. 2,540,085, 2,597,876, 2,597,915, 2,399,083 and the like), sensitization by metal ion of the VII group, sulfur sensitization (U.S. Pat. Nos. 1,574,944, 2,278,947, 2,440,206, 2,410,689, 2,521,926, 3,021,215, 3,038,805, 3,189,458, 3,415,649, 3,635,717 and the like), reduction sensitization (U.S. Pat. Nos. 2,518,698, 2,419,974 and 2,983,610, *Research Disclosure,* Vol. 176 (1978, 12) RD-17643, the III paragraph and the like), or various sensitization processes complexed thereof.

Examples of other useful chemical sensitizers include sulfur sensitizer such as allyl thiocarbamide, thiourea, sodium thiosulfate, thioether, cystine and the like; noble metal sensitizer such as potassium chlorooleyte, oleus.-thiosulfate, potassium chloro palladate and the like; reduction sensitizer such as tin chloride, phenyl hydrazine, reductones and the like.

Besides, they may contain a sensitizer such as polyoxyethylene derivatives (British Pat. No. 981,470, Japanese Patent Publication No. 6475/56, U.S. Pat. No. 2,716,062 and the like), polyoxypropylene derivatives, derivatives having a tertiary ammonium group and the like.

The emulsion can contain a suitable antifoggant and stabilizer. Examples of the compound include thiazolium salts as described in U.S. Pat. No. 2,131,038, 2,694,716, and the like; azaindens as described in U.S. Pat. No. 2,886,437, 2,444,605 and the like; urazoles as described in U.S. Pat. No. 3,287,135 and the like; sulfocatecoles as described in U.S. Pat. No. 3,236,652 and the like; oximes as described in British Pat. No. 623,448 and the like; mercaptotetrazoles as described in U.S. Pat. Nos. 2,403,927, 3,266,897, 3,397,987 and the like; nitrone; nitroindazoles; polyvalent metal salts as described in U.S. Pat. Nos. 2,839,405 and the like; thiuronium salts as described in U.S. Pat. No. 3,220,839 and the like; salts of palladium, platinum and gold as described in U.S. Pat. Nos. 2,566,263, 2,597,915 and the like.

The emulsion can contain a developing agent, for example, hydroquinones; catecoles; aminophenols; 3-pyrazolidones; ascorbic acid and its derivatives; reductones and phenylenediamines, or a combination of the developing agents. The developing agent can be added to the emulsion layer and/or other photographic layers (e.g., a protecting layer, an intermediate layer, a filter layer, an antihalation layer, a back layer and the like). The developing agent can be added by dissolving in a suitable solvent or in a form of a dispersion which is described in U.S. Pat. No. 2,592,368 and French Pat. No. 1,505,778.

The silver halide can be dispersed in a colloid which can be hardened by various organic or inorganic hardeners, e.g., formaldehyde, chromalum, 1-hydroxy-3,5-dichlorotriazine soda, glyoxal, dichloroacrolein and the like.

The emulsion can contain a coating assistant, e.g., saponin, alkylarylsulfonates as described in U.S. Pat. No. 2,600,831 and the like, anphoteric compounds as described in U.S. Pat. No. 3,133,816 and the like.

The emulsion can also contain an antistatic agent, a plasticizer, an brightening agent, a development accelerator, an air-antifoggant, a tone agent and the like.

The emulsion can contain a so-called non-diffusion couplers. Useful couplers include those of the 4-equivalent type of diketomethylene type yellow couplers and 2-equivalent type of diketomethylene type yellow couplers, e.g., the compounds as described in U.S. Pat. Nos. 3,277,157, 3,415,652, 3,447,928, 3,311,476, 3,408,194 and the like, the compounds as described in U.S. Pat. Nos. 2,875,057, 3,265,506, 3,409,439, 3,551,155, 3,551,156 and the like, or the compounds as described in Japanese Patent Application (OPI) Nos. 26133/72, 66836/73 and the like; 4-equivalent type or 2-equivalent type of pyrazolone type magenta couplers and indazolone type magenta couplers, e.g., the compounds as described in U.S. Pat. Nos. 2,600,788, 2,983,608, 3,006,759, 3,062,653, 3,214,437, 3,253,924, 3,419,391, 3,419,808, 3,476,560 and 3,582,322, Japanese Patent Publication No. 20636/70, Japanese Patent Application (OP) No. 26133/72 and the like; α-naphthol type cyan couplers and phenol type cyan couplers, e.g., the compounds as described in U.S. Pat. Nos. 2,474,293, 2,698,794, 3,034,892, 3,214,437, 3,253,924, 3,311,476, 3,458,315 and 3,591,383, Japanese Patent Publication Nos. 11304/67 and 32461/69, Japanese Patent Application (OPI) No. 109630/78 and the like.

Furthermore, development inhibiting compound releasing type couplers (a so-called DIR coupler) and the compounds which release a development inhibiting compound in coloring reaction can also be added. These examples are described in U.S. Pat. Nos. 3,148,062, 3,227,554, 3,253,924, 3,617,291, 3,622,328 and 3,705,201, British Pat. No. 1,201,110, U.S. Pat. Nos. 3,297,445, 3,379,529 and 3,639,417 and the like.

Cyan couplers having an ureido group in which the fading of dye is improved are preferably used because their fastness to light and heat are excellent. Examples of these are described in U.S. Pat. Nos. 3,446,622, 3,996,253, 3,758,308 and 3,880,661, Japanese Patent Application (OPI) Nos. 65134/81, 1620/82, 72202/82, 98731/83 and the like.

It is preferred that the cyan coupler is added to the emulsion comprising the dye represented by the general formula (I) and the compound represented by the general formula (II).

The above-mentioned couplers can be used together with two or more kinds in the same layer in order to satisfy the characteristics required to photographic materials and also the same compound, of course, can be added to two or more layers.

The above-mentioned couplers include the couplers having a water-soluble group such as carboxyl, hydroxyl, sulfo groups and the like and hydrophobic couplers, which are introduced to the emulsion by using an addition process or dispersion process conventionally used. In the case of the hydrophobic couplers, a process of dispersing with the aid of an anionic surfactant by mixing an organic solvent having a high boiling point such as phthalates, trimeritic acid esters, phosphoric acid esters, fatty oil, wax and the like which are liquid at normal temperature, with a coupler, for example, the processes as described in U.S. Pat. Nos. 2,304,939, 2,322,027 and the like; a process of dispersing by mixing a coupler with an organic solvent having a low boiling point or a water-soluble organic solvent, for example, the processes as described in U.S. Pat. Nos. 2,801,170, 2,801,171, 2,949,360 and the like; a process of dispersing by using together with a coupler which must be used alone or together with others when the coupler itself has a low boiling point (preferably 75° C. or less), e.g., colored coupler, DIR coupler and other couplers, for example, the process as described in German Pat. No. 1,143,707 and the like can be applied. The water-soluble coupler can be added as an alkali solution or as an assistant for dispersion of a hydrophobic coupler (as one of anionic surfactants) together with a hydrophobic coupler.

Besides, the color image can be formed by developing with a color developer which contains a diffusive coupler.

Irradiation inhibiting dye is contained according the purpose. Examples thereof include those as described in Japanese Patent Publication Nos. 20389/66, 3504/68 and 13168/68, U.S. Pat. Nos. 2,697,037, 3,423,207 and 2,865,752, British Pat. Nos. 1,030,392, 1,100,546 and the like.

The sensitizing dyes of this invention can be used in combination with other sensitizing dyes. For example, the sensitizing dyes as described in U.S. Pat. Nos. 3,703,377, 2,688,545, 3,397,060, 3,615,635 and 3,628,964, British Pat. Nos. 1,242,588 and 1,293,862, Japanese Patent Publication Nos. 4936/68, 14030/69 and 10773/68, U.S. Pat. No. 3,416,927, Japanese Patent Publication No. 4930/68, U.S. Pat. Nos. 3,615,613, 3,615,632, 3,617,295 and 3,635,721 and the like can be used.

This invention can apply to the sensitization of emulsions using for various color photographic materials, as well as monochromic emulsions. Examples of useful emulsions include color positive emulsions, color paper emulsions, color negative emulsions, color reversal emulsions (they may or may not contain couplers), emulsions using for color diffusion transfer process (as described in U.S. Pat. Nos. 3,087,817, 3,185,567, 2,983,606, 3,253,915, 3,227,550, 3,227,551, 3,227,552, 3,415,644, 3,415,645, 3,415,646 and the like), the emulsions using for dye transfer process (described in U.S. Pat. No. 2,882,156 and the like), the emulsion using for silver dye bleaching process (described in "History of Color Photography" by Friedman, American Photographic Publishers Co., 1944, particularly, Article 24, "British Journal of Photography", Vol. 111, pp. 308–309, Apr. 7 (1964) and the like) and the like.

As the multilayer color photographic materials which are applicable to this invention, a photographic material consisting of at least three layers of a red-sensitive emulsion layer (R), a green-sensitive emulsion layer (G) and blue-sensitive emulsion layer (B) is preferably used and a photographic material wherein each emulsion layer [(R), (G) or (B)] comprises a coupler is more preferably used.

The layer structure of multilayer color photographic materials which is applicable to this invention is not particularly limited, for example, it may be coated, from the support, in order of (B), (G) and (R), or in order of (R), (G) and (B). Also, it may be coated in order of (B), (R) and (G). When the (R), (G), and (B) order is used, a yellow filter is desirably used between (G) and (B).

The emulsion is coated on a support together with other photographic layers, if occasion demands. Namely, it can be coated by various coating processes including dip coating, air-knife coating, curtain coating or extrusion coating using a hopper as described in U.S. Pat. No. 2,681,294.

If occasion demands, two or more kinds of layers can be coated simultaneously by the process as described in U.S. Pat. Nos. 2,761,791, 3,508,947, 2,941,898, 3,526,528 and the like.

Useful supports include plane materials which do not cause a remarkable size change in processing, for example, rigid materials such as glass, metal and china, or flexible supports, according to the purposes. Typical examples of the flexible supports include a cellulose nitrate film, a cellulose acetate film, a cellulose acetate butylate film, a cellulose acetatepropionate film, a polystylene film, a polyethylene terephthalate film, a polycarbonate film, their laminated products, a thin glass film, papers and the like, which are generally employed in the photographic materials. The supports such as the paper coated or laminated by baryta or $\alpha$-olefin polymer, especially $\alpha$-olefin polymers containing 2 to 10 carbon atoms such as polyethylene, polypropylene, ethylenebutene copolymer and the like, a plastic film in which the adhesion with other high molecular substances is improved and the printer suitability is increased by coarsening the surface as described in Japanese Patent Publication No. 19068/72, and the like also afford a satisfactory result.

These supports may be transparent ones or opaque ones according to the purposes of the photographic materials. Transparent supports may be colorless transparent materials or materials made colored-transparent by adding dyes and pigments. This has been carried out in X-ray films as described in J. SMPTE, Vol. 67, p. 296 (1958) and the like.

Examples of opaque supports include opaque ones such as papers and those in which a dye and a pigment such as titanium oxide are added to a transparent film, or plastic films whose surface is treated by the process as described in Japanese Patent Publication No. 19068/72, papers and also plastic films to which carbon black, dyes and the like are added to completely light-shield the film. When the adhesion between the support and the emulsion layer is insufficient, a layer which shows the adhesivity against both of them is generally included as an undercoating layer. Also, the surface of the support may be preliminarily treated with corona discharge, ultraviolet-ray irradiation, flame treatment and the like in order to further improve the adhesivity.

The photographic material of this invention can be color-developed using an aromatic primary amine compound such as p-phenylenediamine derivatives. The typical examples of the color developer include inorganic acid salts such as N,N-diethyl-p-phenylenediamine, 2-amino-5-diethylaminotoluene, 2-amino-5-(N-ethyl-N-laurylamino)toluene, 4-[N-ethyl-N-($\beta$-hydroxyethyl)amino]aniline, 3-methyl-4-amino-N-ethyl-N-($\beta$-hydroxyethyl)aniline and the like, 4-amino-3-methyl-N-ethyl-N-($\beta$-methanesulfoamidoethyl)anilinesesquisulfate monohydrate as described in U.S. Pat. No. 2,193,015, N-(2-amino-5-diethylaminophenylethyl)methanesulfoamide sulfate described in U.S. Pat. No. 2,592,364, N,N-dimethyl-p-phenylenediaminehydrochloride, 3-methyl-4-amino-N-ethyl-N-methoxydiethylaniline described in Japanese Patent Application (OPI) No. 64933/73 and the like.

The details of these color developing agent are described in "Photographic Processing Chemistry" by L. F. A. Mason (Focal Press London, 1966), pp. 226–229 and the like. Moreover, 3-pyrazolidones can be used together with them.

Various additives can be added to the color developer as occasion demands.

Typical examples of additives for the developers include alkali agents (e.g., hydroxides, carbonates and phosphates of alkali metal and ammonium), pH modifiers or buffers (e.g., weak acids and weak bases such as a cetic acid and boric acid, and their salts), development accelerators (e.g., various pyridinium compounds and cationic compounds as described in U.S. Pat. Nos. 2,648,604 and 3,671,247, potassium nitrate and sodium nitrate, polyethylene glycol condensation products and their derivatives as described in U.S. Pat. Nos. 2,533,990, 2,577,127 and 2,950,970, nonionic compounds such as polythio ethers represented by the compounds as described in British Pat. Nos. 1,020,033 and 1,020,032 and the like, polymer compounds having a sulfite ester as represented by the compounds as described in U.S. Pat. No. 3,068,097, organic amines such as pyridine, ethanolamine and the like, benzyl alcohol, hydrazines and the like), antifoggants (e.g., alkali bromides, alkali iodide, nitrobenzimidazoles as described in U.S. Pat. Nos. 2,496,940 and 2,656,271, and also mercaptobenzimidazole, 5-methylbenztriazole, 1-phenyl-5-mercaptotetrazole, the compounds for rapid processing as described in U.S. Pat. Nos. 3,113,864, 3,342,596, 3,295,976, 3,615,522, 3,597,199 and the like, thiosulfonyl compounds described in British Pat. No. 972,211, phenadine N-oxides as described in Japanese Patent Publication No. 41675/71, fog restrainers described in Scientific Photograph Handbook, Second Volume, pp.

29–47, and the like), moreover, stain or sludge inhibitors as described in U.S. Pat. Nos. 3,161,513 and 3,161,514, and British Pat. Nos. 1,030,442, 1,144,481 and 1,251,558, interlayer effect accelerators known by U.S. Pat. No. 3,536,487 and the like, and preservatives (e.g., sulfites, acidic sulfites, hydroxylamine hydrochlorites, formsulfite, alkanolaminesulfite adducts and the like).

The emulsion is fixed by a conventional method after development, but in some cases a bleaching process may be carried out. The bleaching process may be carried out simultaneously with fixing or independently. When bleaching is carried out simultaneously with fixing, a bleaching agent and a fixing agent are mixed to be a bleaching-fixing bath. As the bleaching agent, many compounds can be used, but among them, ferricyanides, dichromates, water-soluble cobalt (III) salts, water-soluble copper (II) salts, water-soluble quinones, polyvalent metal compounds such as nitrosophenol, iron (III), cobalt (III), copper (II) and the like, particularly complex salts of these polyvalent metal cation with an organic acid, e.g., metal complex salts of aminopolycarboxylic acids such as ethylenediaminetetraacetic acid, nitrilotriacetic acid, iminodiacetic acid and N-hydroxyethylethylenediaminetriacetic acid, malonic acid, tartaric acid, malic acid, diglycolic acid and dithioglycolic acid, and copper complex salts of 2,6-dipicolinic acid, peracids, e.g., alkyl peracids, persulfates, permangnates, hydrogen peroxide and the like, and hypochlorites, e.g., chlorine, bromine, bleaching powder and the like are generally used independently or in their suitable combination. The details of the bleaching and fixing, or the bleaching-fixing are described in U.S. Pat. No. 3,582,322 and the like. To this processing solution, various additives, as well as bleaching accelerators as described in U.S. Pat. Nos. 3,042,520 and 3,241,966, Japanese Patent Publication Nos. 8506/70 and 8836/70 and the like can be added.

This invention can apply to photographic materials having a low content of silver in which the amount of silver halide in the emulsion is about ½ to 1/100, compared with usual photographic materials.

These color photographic materials in which the amount of silver halide is diminished can afford a satisfactory color image by a development process for increasing the amount of the formed dye by halogenation bleaching of the developed silver which is formed by color development, followed by color development again (e.g., U.S. Pat. Nos. 2,623,822, 2,814,565 and the like), an image forming process for increasing the amount of the formed dye by utilizing color intensification which uses peroxides and cobalt complex salts (e.g., German Patent Application (OLS) Nos. 1,598,076, 1,900,540, 1,900,864, 1,917,744, 2,044,833, 2,056,360, 2,226,770, 2,357,694 and 2,357,695, U.S. Pat. Nos. 3,674,490, 3,761,265 and 3,765,890, Japanese Patent Application (OPI) Nos. 9728/73, 9729/73, 84239/74, 84240/74 and the like, an image forming process for increasing the amount of the formed dye by utilizing color intensification which uses chlorous acid and bromous acid (e.g., Japanese Patent Application (OPI) Nos. 53826/76, 99022/76 and the like) and the like.

WORKING EXAMPLE 1

To 100 g of a gelatin silver iodobromide emulsion (I: 8 mol%; Br: 92 mol%; Ag: $5.0\times10^{-2}$ mol; gelatin: 7 g) was added each $2.5\times10^{-4}$ mol/l methanol solution of the sensitizing dyes in a fixed amount (refer to Table 1) and furthermore a fixed amount (refer to Table 1) of $5\times10^{-3}$ mol/l methanol (containing 4 ml of 4N—NaOH) of a compound selected from the general formula (II) was added. The mixture was allowed to stand with stirring at 40° C. for about 1 hour and coated on a cellulose triacetate film base so as to be about 5μ in dry layer thickness. After drying, the film was exposed by optical wedge using a red filter which transmits only light having a wavelength which is longer than 600 nm, developed at 24° C. for 2 minutes using the following developer, fixed, washed and dried. The density was measured using a P type densitometer manufactured by Fuji Photo Film Co., Ltd. The basic point of optical density by which the sensitivity is determined was the point of "Fog+0.1". The results are summarized in Table 1.

| Developer prescription | |
|---|---|
| N—Methyl-p-aminophenol sulfate | 2.0 g |
| Hydroquinone | 8.0 g |
| Sodium sulfite (anhydrate) | 90.0 g |
| Sodium carbonate $H_2O$ | 52.5 g |
| Potassium bromide | 5.0 g |
| The total amount by adding water | 1 l |

TABLE 1

| | Sensitizing Dye ($2.5\times10^{-4}$ mol/l) | | Compound ($5\times10^{-3}$ mol/l) | | | |
|---|---|---|---|---|---|---|
| Sample No. | Dye No. | Addition Amount (ml/l Kg of Emulsion) | Compound No. | Addition Amount (ml/l Kg of Emulsion) | Relative Sensitivity | Fog (Total Density Containing Base) |
| 1 | I - 1 | 20 | — | | 100 (basis) | 0.06 |
| 2 | | 40 | — | | 87 | 0.07 |
| 3 | " | 20 | II - 1 | 50 | 209 | 0.03 |
| 4 | | 40 | | 50 | 240 | 0.03 |
| 5 (for comparison) | " | 20 | Compound A | 50 | 170 | 0.05 |
| 6 | | 40 | | 50 | 178 | 0.06 |
| 7 | I - 5 | 20 | — | | 115 | 0.07 |
| 8 | | 40 | — | | 102 | 0.07 |
| 9 | " | 20 | II - 1 | 50 | 219 | 0.03 |
| 10 | | 40 | | 50 | 263 | 0.03 |
| 11 | I - 14 | 20 | — | | 95 | 0.07 |
| 12 | | 40 | — | | 83 | 0.08 |
| 13 | " | 20 | II - 1 | 50 | 195 | 0.03 |
| 14 | | 40 | | 50 | 229 | 0.03 |
| 15 (for comparison) | Dye A | 20 | — | | 87 | 0.07 |

TABLE 1-continued

| Sample No. | Sensitizing Dye ($2.5 \times 10^{-4}$ mol/l) Dye No. | Addition Amount (ml/l Kg of Emulsion) | Compound ($5 \times 10^{-3}$ mol/l) Compound No. | Addition Amount (ml/l Kg of Emulsion) | Relative Sensitivity | Fog (Total Density Containing Base) |
|---|---|---|---|---|---|---|
| 16 | | 40 | — | | 79 | 0.08 |
| 17 | | 20 | II - 1 | 50 | 115 | 0.06 |
| 18 | | 40 | | 50 | 129 | 0.07 |

Dye A

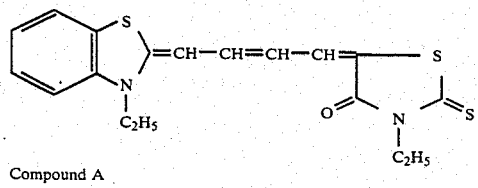

Compound A

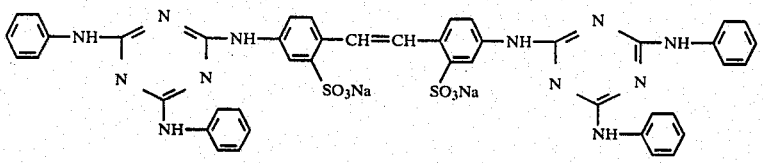

Table 1 shows that the dye alone or the combination for comparison does not afford sufficient sensitivity and the fog is increased. However, the combination of this invention (the combination of the dye I and the compound II) can afford photographic material having a high sensitivity and little fog.

WORKING EXAMPLE 2

As a yellow dye forming coupler, a silver chlorobromide emulsion (Br: 90 mol%; Cl: 10 mol%) containing α-(4-palmitoamidophenoxy)-α-pivaloyl-4-sulfoamylacetanilide (described in U.S. Pat. No. 3,408,194) was coated on a photographic paper covered with polyethylene to make a blue-sensitive emulsion layer. The blue-sensitive emulsion layer contains 2-n-octadecyl-5-(2-sulfo-tert-butyl)hydroquinone potassium salt (stain inhibitor), blue-sensitive sensitizing dyes and 4-hydroxy-6-methyl-1,3,3a,7-tetraazaindene. On the blue-sensitive emulsion layer, a gelatin intermediate layer containing dioctylhydroquinone was coated. On the gelatin intermediate layer, a green-sensitive silver chlorobromide emulsion (Br: 70 mol%; Cl: 30 mol%) containing 1-phenyl-3-methyl-4-(4-methylsulfonylphenoxy)-5-pyrazolone was coated as magenta dye image forming coupler to make a green-sensitive emulsion layer. The coupler was used by dispersing in tricresylphosphate (a coupler solvent generally used). The green-sensitive emulsion layer contains dioctylhydroquinone (stain inhibitor), green-sensitive sensitizing dyes and 4-hydroxy-6-methyl-1,3,3a,7-tetraazaindene. On the green-sensitive emulsion layer a gelatin layer containing dioctylhydroquinone which was dispersed in tricresylphosphate (solvent) was coated. The sensitizing dye included in the general formula (I) by this invention and red-sensitive sensitizing dyes for comparison were added to the silver chlorobromide emulsion (Br: 70 mol%; Cl: 30 mol%) in a fixed amount (Table 2) and furthermore the compound included in the general formula (II) was added to afford a red-sensitive emulsion. To this was added 1-hydroxy-4-maleimido-3-naphthamide as cyan dye forming coupler and coated on the gelatin layer to make a red-sensitive emulsion layer. The coupler was dispersed in dibutylphthalate. The red-sensitive emulsion layer contains dioctylhydroquinone (stain inhibitor) and 4-hydroxy-6-methyl-1,3,3a,7-tetraazaindene.

One part of the above sample was kept at room temperature (20° C., relative humidity 60%) and the other part was kept at high temperature and high humidity (50° C., relative humidity 80%) for 2 days and then they were exposed by optical wedge using a red filter and the following development was carried out.

For these samples, the red color density (the density was measured using a red filter) and the amount of diffuse sensitization (the density was measured using a blue filter) were measured. These density measurements were carried out using the P type densitomer manufactured by Fuji Photo Film Co., Ltd. The basic point of optical density by which the sensitivity was determined was the point of "Fog+1.0". The obtained results are summarized in Table 2.

| Processing | Color development Temp. | Time |
|---|---|---|
| Color Development | 130° C. | 6 min. |
| Stopping | " | 2 min. |
| Washing | " | 2 min. |
| Bleaching fixing | " | 1 min. 30 sec. |
| Washing | " | 2 min. |
| Stable bath | " | 2 min. |
| Drying | | |

The processing solutions had the following compositions.

| Color developer | |
|---|---|
| Benzyl alcohol | 12.0 ml |
| Diethylene glycol | 3.5 ml |
| Sodium hydroxide | 2.0 g |
| Sodium sulfite | 2.0 g |
| Potassium bromide | 0.4 g |
| Sodium chloride | 1.0 g |
| Borax | 4.0 g |
| Hydroxylaminesulfate | 2.0 g |
| Disodium ethylenediaminetetraacetate.$2H_2O$ | 2.0 g |
| N—Ethyl-N—(β-methanesulfonamidethyl)aniline sesquisulfate monohydrate | 5.0 g |

-continued

| | |
|---|---|
| The total amount by adding water | 1 l |
| Stop solution | |
| Sodium thiosulfate | 10 g |
| Ammonium thiosulfate (70%) | 30 ml |
| Sodium acetate | 5 g |
| Acetic acid | 30 ml |
| Potassium alum | 15 g |
| The total amount by adding water | 1 l |
| Bleaching fixing solution | |
| Ferric sulfate | 20 g |
| Disodium ethylenediaminetetraacetate.$2H_2O$ | 36 g |
| Sodium carbonate.$H_2O$ | 17 g |
| Sodium sulfite | 5 g |
| 70% aqueous solution of ammonium thiosulfate | 100 ml |
| Boric acid | 5 g |
| The total amount by adjusting to pH 6.8 and adding water | 1 l |
| Stabilizer | |
| Boric acid | 5 g |
| Sodium citrate | 5 g |
| Sodium methaborate.$4H_2O$ | 3 g |
| Potassium alum | 15 g |
| The total amount by adding water | 1 l |

comparison but can be restrained by the combination of this invention.

WORKING EXAMPLE 3

To 100 g of a gelatin silver chlorobromide emulsion (Cl: 40 mol%; Br: 60 mol%; Ag: $5.0\times10^{-2}$ mol; gelatin: 7 g) was added the sensitizing dye (I) and the compound (II) in a fixed amount (refer to Table 3) and furthermore the following compound was added as a cyan coupler.

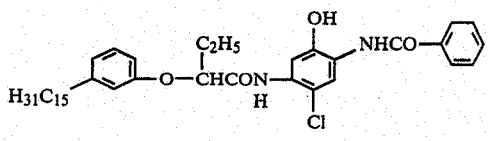

Diocrylhydroquinone was added to the emulsion as a stain inhibitor.

The emulsion was divided into two, and one part was stirred at 40° C. for 30 minutes and the other was stirred at 40° C. for 7 hours and then they were coated on a film base. The above sample was exposed by optical wedge using a red filter and the same color development as Working Example 2 was carried out. The results are summarized in Table 3.

TABLE 2

| Sample No. | Sensitizing Dye ($5\times10^{-4}$ mol/l) Addition Amount (ml/l Kg of Emulsion) | | Compound ($5\times10^{-3}$ mol/l) Addition Amount (ml/l Kg of Emulsion) | | Relative Sensitivity: Sample at r.t. (20° C., 60% RH) Measurement, By Red Filter | Sample at r.t. (20° C., 60% RH) Measurement, By Blue Filter | Sample at High Humidity (50° C., 80% RH) Measurement, By Red Filter | Sample at High Humidity (50° C., 80% RH) Measurement, By Blue Filter |
|---|---|---|---|---|---|---|---|---|
| 1 | I - 3 | 40 | — | | 100 (basis) | — | 79 | 24 |
| 2 | | 80 | — | | 85 | — | 71 | 26 |
| 3 | " | 40 | II - 2 | 100 | 195 | — | 186 | — |
| 4 | | 80 | | 100 | 295 | — | 288 | — |
| 5 | " | 40 | II - 3 | 100 | 219 | — | 209 | — |
| 6 | | 80 | | 100 | 339 | — | 331 | — |
| 7 | " | 40 | Compound A | 100 | 148 | — | 132 | 11 |
| 8 | | 80 | | 100 | 199 | — | 178 | 15 |
| 9 | I - 9 | 40 | — | | 100 (basis) | — | 79 | 26 |
| 10 | | 80 | — | | 93 | — | 74 | 34 |
| 11 | " | 40 | II - 5 | 100 | 204 | — | 195 | — |
| 12 | | 80 | | 100 | 302 | — | 295 | — |
| 13 | " | 40 | II - 7 | 100 | 195 | — | 186 | — |
| 14 | | 80 | | 100 | 288 | — | 282 | — |
| 15 | " | 40 | Compound A | 100 | 155 | — | 141 | 14 |
| 16 | | 80 | | 100 | 191 | — | 178 | 23 |

Compound A: Sodium 4,4'-bis(4,6-dianilino-s-triazin-2-ylamino)-stilbene-2,2'-disulfonate Table 2 shows that the diffuse sensitization is caused in the case of the dye alone or the combination for

TABLE 3

| Sample No. | Sensitizing Dye ($5\times10^{-4}$ mol/l) Addition Amount ml/l Kg of Emulsion | | Additive ($5\times10^{-3}$ mol/l) Addition Amount ml/l Kg of Emulsion | | Relative Sensitivity: Lapse of Dissolution 30 min | Lapse of Dissolution 7 hr |
|---|---|---|---|---|---|---|
| 1 | I - 2 | 60 | — | | 100 (basis) | 54 |
| 2 | " | 60 | II - 3 | 100 | 339 | 324 |
| 3 | | 60 | | 200 | 363 | 363 |
| 4 | " | 60 | II - 10 | 100 | 282 | 275 |
| 5 | | 60 | | 200 | 295 | 289 |
| 6 | I - 8 | 60 | — | | 100 (basis) | 47 |
| 7 | " | 60 | II - 3 | 100 | 355 | 347 |
| 8 | | 60 | | 200 | 363 | 355 |
| 9 | " | 60 | II - 10 | 100 | 302 | 288 |
| 10 | | 60 | | 200 | 309 | 302 |
| 11 | I - 4 | 60 | — | | 100 (basis) | 45 |

TABLE 3-continued

| Sample No. | Sensitizing Dye ($5 \times 10^{-4}$ mol/l) | Addition Amount ml/l Kg of Emulsion | Additive ($5 \times 10^{-3}$ mol/l) | Addition Amount ml/l Kg of Emulsion | Relative Sensitivity Lapse of Dissolution 30 min | Relative Sensitivity Lapse of Dissolution 7 hr |
|---|---|---|---|---|---|---|
| 12 | " | 60 | II - 3 | 100 | 316 | 302 |
| 13 | " | 60 | | 200 | 339 | 331 |
| 14 (for comparison) | Dye A | 60 | — | | 100 (basis) | 49 |
| 15 (for comparison) | " | 60 | II - 3 | 100 | 126 | 79 |
| 16 (for comparison) | | 60 | | 200 | 135 | 91 |
| 17 (for comparison) | " | 60 | II - 10 | 100 | 117 | 70 |
| 18 (for comparison) | | 60 | | 200 | 129 | 85 |

From Table 3, it can be seen that the combination of this invention shows lesser lowering of sensitivity in the lapse of dissolution, compared with the dye alone and the samples for comparison.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support having thereon a red-sensitive silver halide photographic emulsion layer comprising a tetramethine melocyanine dye represented by the general formula (I) and a compound represented by the general formula (II)

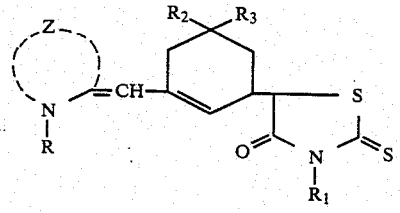

(I)

wherein R and $R_1$ each represents an alkyl group, a substituted alkyl group, an aryl group, a substituted aryl group or an allyl group, and at least one of R and $R_1$ represents an alkyl group containing a sulfo group or an alkyl group containing a carboxyl group, $R_2$ and $R_3$ each represented an alkyl group, Z represents a nonmetal atomic group necessary to complete a 5-membered or 6-membered heterocyclic nucleus containing nitrogen,

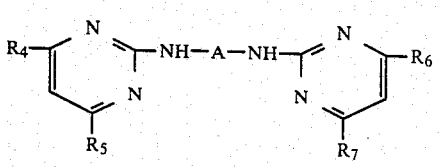

(II)

wherein A represents a divalent aromatic residue, $R_4$, $R_5$, $R_6$ and $R_7$ independently represent a hydrogen atom, a hydroxy group, a lower alkyl group, an alkoxy group, an aryloxy group, a halogen atom, a heterocyclic group, an alkylthio group, a heterocyclylthio group, an arylothio group, an amino group, a substituted or unsubstituted alkylamino group, a substituted or unsubstituted arylamino group, a heterocyclylamino group, a substituted or unsubstituted aralkylamino group, an aryl group or a mercapto group, and at least one of A, $R_4$, $R_5$, $R_6$ and $R_7$ represents a group substituted with at least one sulfo group.

2. A silver halide photographic light-sensitive material as claimed in claim 1, wherein R and $R_1$ each represents an alkyl group containing 1 to 10 carbon atoms, a substituted alkyl group (the alkyl moiety containing 1 to 10 carbon atoms), an aryl group containing 4 to 15 carbon atoms and a substituted aryl group (the aryl moiety containing 4 to 15 carbon atoms).

3. A silver halide photographic light-sensitive material as claimed in claim 1, wherein $R_2$ and $R_3$ each represents an alkyl group containing 1 to 5 carbon atoms.

4. A silver halide photographic light-sensitive material as claimed in claim 2, wherein the substituted alkyl group represents an alkyl group containing a sulfo group (the alkyl moiety containing 1 to 4 carbon atoms and an alkyl group containing a carboxy group (the alkyl moiety containing 1 to 4 carbon atoms).

5. A silver halide photographic light-sensitive material as claimed in claim 4, wherein the alkyl group containing a sulfo group represents a sulfoalkyl group, an alkyl group substituted by a hydroxy, acetoxy or alkoxy (the alkyl radical containing 1 to 4 carbon atoms) group and a sulfo group and a sulfoaralkyl group.

6. A silver halide photographic light-sensitive material as claimed in claim 1, wherein the 5-membered or 6-membered heterocyclic nucleus containing nitrogen completed together with a nonmetal atomic group represented by Z represents a thiazole nucleus, a gelenazole nucleus, an oxazole nucleus, a quinoline nucleus, a 3,3-dialkylindolenine nucleus, an imidazole nucleus and a pyridine nucleus.

7. A silver halide photographic light-sensitive material as claimed in claim 6, wherein the heterocyclic nucleus represents a thiazole nucleus and an oxazole nucleus.

8. A silver halide photographic light-sensitive material as claimed in claim 7, wherein the heterocyclic nucleus represents a benzothiazole nucleus, a naphthothiazole nucleus and a naphthoxazole nucleus.

9. A silver halide photographic light-sensitive material as claimed in claim 1, wherein $R_4$, $R_5$, $R_6$ and $R_7$ each represent an alkyl group containing 1 to 8 carbon atoms and an alkoxy group containing 1 to 8 carbon atoms.

10. A silver halide photographic light-sensitive material as claimed in claim 1, wherein A selects from the following $A_1$ or $A_2$:

$A_1$:

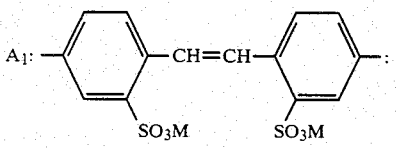

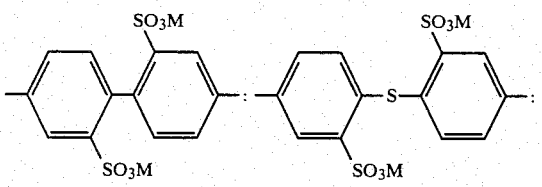

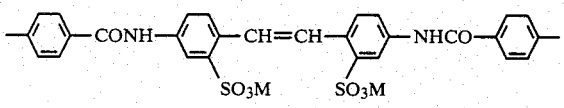

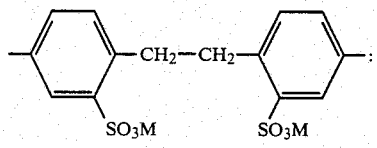

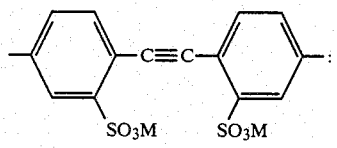

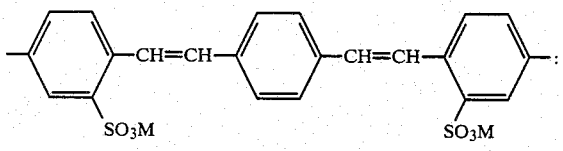

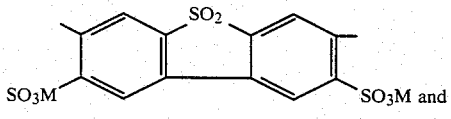

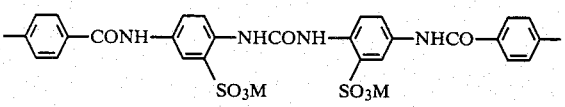

wherein M represents a hydrogen atom or a cation which affords water-solubility, $A_2$:

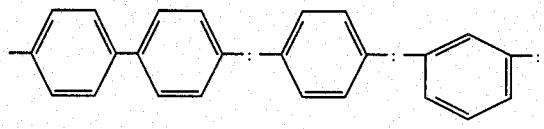

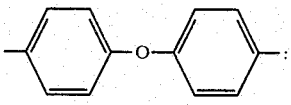

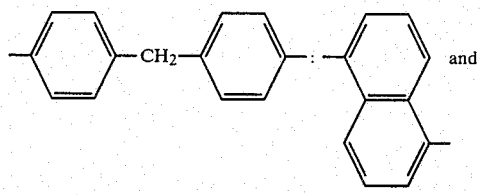

and

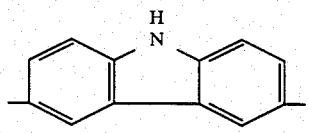

11. A silver halide photographic light-sensitive material as claimed in claim 1, wherein the tetramethine melocyanine dye is present in a concentration of about $2\times10^{-6}$ mol to $1\times10^{-3}$ mol per 1 mol of silver halide.

12. A silver halide photographic light-sensitive material as claimed in claim 1, wherein the compound represented by the general formula (II) is present in an amount in the range of 0.01 g to 5 g per 1 mol of silver halide.

13. A silver halide photographic light-sensitive material as claimed in claim 12, wherein the ratio by weight of the dye of general formula (I) to the compound of general formula (II) is in the range of $\frac{1}{2}$ to 1/200.

14. A silver halide photographic light-sensitive material as claimed in claim 13, wherein the weight ratio of dye (I)/Compound (II) is in the range of 1/5 to 1/100.

15. A silver halide photographic light-sensitive material as claimed in claim 1, wherein the red-sensitive silver halide photographic emulsion layer includes a cyan coupler.

16. A silver halide photographic light-sensitive material as claimed in claim 1, wherein the silver halide photographic light-sensitive material further comprises a green-sensitive silver halide photographic emulsion layer and a blue-sensitive silver halide photographic emulsion layer.

17. A silver halide photographic light-sensitive material as claimed in claim 16, wherein each of the red-sensitive, green-sensitive and blue-sensitive silver halide photographic emulsion layers include couplers.

* * * * *